United States Patent [19]

Keuchel

[11] Patent Number: 4,790,736

[45] Date of Patent: Dec. 13, 1988

[54] APPARATUS FOR CENTRIFUGAL FIBER SPINNING WITH PRESSURE EXTRUSION

[75] Inventor: Herbert W. Keuchel, Tallmadge, Ohio

[73] Assignee: John E. Benoit, Annandale, Va. ; a part interest

[21] Appl. No.: 632,733

[22] Filed: Jul. 20, 1984

[51] Int. Cl.[4] ..... D01D 1/09; D01D 5/18

[52] U.S. Cl. ..... 425/66; 425/72.2; 425/135; 425/144; 425/145; 425/150; 425/190; 425/192 S; 425/378.2; 425/381.2; 425/382.2; 425/404; 425/437; 425/445; 425/464; 425/379.1; 156/436; 156/441

[58] Field of Search ..... 264/8, 103, 167, DIG. 81, 264/164, 114, 311; 425/8, 382 N, 381.2, 464, 66, 72.2, 144, 145, 150, 135, 190, 192 S, 378.2, 379.2, 381.2, 382.2, 404, 437, 445; 156/436, 441

[56] References Cited

U.S. PATENT DOCUMENTS

| | | | |
|---|---|---|---|
| 1,293,535 | 2/1919 | Perry | 264/311 |
| 3,032,456 | 5/1962 | Wade | 264/6 |
| 3,080,736 | 3/1963 | Mabru et al. | 65/8 |
| 3,245,116 | 4/1966 | Hendry | 425/166 |
| 3,388,194 | 6/1968 | Vinicki | 264/6 |
| 3,409,712 | 11/1968 | Chisholm | 264/142 |
| 3,483,281 | 12/1969 | Chisholm | 264/25 |
| 3,596,312 | 8/1971 | Ohmatsu | 425/197 |
| 3,649,147 | 3/1972 | Fritsch | 425/170 |
| 3,924,841 | 12/1975 | Shinmoto | 259/191 |
| 4,118,163 | 10/1978 | Lee | 425/146 |
| 4,211,736 | 7/1980 | Bradt | 264/8 |
| 4,266,919 | 5/1981 | Dunnington et al. | 425/102 |
| 4,277,436 | 7/1981 | Shah et al. | 264/518 |
| 4,288,397 | 9/1981 | Snowden et al. | 264/8 |
| 4,294,783 | 10/1981 | Snowden | 264/8 |
| 4,336,213 | 6/1972 | Fox | 264/40.1 |
| 4,408,972 | 10/1983 | Layfield | 425/8 |
| 4,412,964 | 11/1983 | Todd et al. | 264/143 |
| 4,440,700 | 4/1984 | Okada et al. | 264/8 |

*Primary Examiner*—Jan H. Silbaugh
*Assistant Examiner*—Hubert C. Lorin
*Attorney, Agent, or Firm*—John E. Benoit

[57] ABSTRACT

An apparatus wherein there is provided a source of fiber forming material, with said fiber forming material being pumped into a die having a plurality of spinnerets about its periphery. The die is rotated at a predetermined adjustable speed, whereby the liquid is expelled from the die so as to form fibers. It is preferred that the fiber forming material be cooled as it is leaving the holes in the spinnerets during drawdown. The fibers may be used to produce fabrics, fibrous tow and yarn through appropriate take-up systems. The pumping system provides a pumping action whereby a volumetric quantity of liquid is forced into the rotational system independent of viscosity or the back pressure generated by the spinnerets and the manifold system of the spinning head, thus creating positive displacement feeding. Positive displacement feeding may be accomplished by the extruder alone or with an additional pump of the type generally employed for this purpose. A rotary union is provided for positive sealing purposes during the pressure feeding of the fiber forming material into the rotating die.

33 Claims, 6 Drawing Sheets

BASED ON EXTRUSION RATE OF 2gm/MIN./HOLE

APPARATUS FOR CENTRIFUGAL FIBER SPINNING WITH PRESSURE EXTRUSION

This application relates generally to pressure extrusion, and more particularly to pressure extrusion coupled with centrifugal fiber spinning for producing continuous and nonwoven fabrics.

One of the constraints of conventional fiber extrusion is the cost and inherent limitation of the mechanical roll systems which are required to pull fibers out of spinnerets at economical speeds. In other systems, the mechanical roll system has been by-passed by using air to pull fibers out of spinnerets at high speed. The air process is difficult to control. It suffers from spinline instability and lack of fiber uniformity. In addition, the use of compressed air is very energy intensive and costly.

Known centrifugal fiber spinning systems also offer very limited utility for fiber production, especially for viscous, thermoplastic polymers, because of low productivity and poor process and product controls. In these systems, fiber forming material is fed by gravity into the interior of a rapidly rotating open cup or die. The fiber forming fluid flows by virtue of the centrifugal force to the interior wall of the cup or die from whence it is spun into fibers from the outlet passages which pass through the wall of the cup or die. The generated centrifugal energy forces the fluid to extrude through the die. The rate of extrusion is relatively low, since the outlet passages have to be relatively small to assure fiber quality and filament stability. The use of large passages to increase productivity is not suitable for fiber extrusion, however. It is mainly for this reason that centrifugal extrusion of this type offers more utility for the production of larger diameter pellets than for the production of fibers, especially when considering thermoplastic polymers.

Only those polymers which are heat resistant and relatively fluid above their melting points may have any practical use for fiber conversion by the above described known spinning process. The literature mentions polypropylene, polyester, ureaformaldehyde and glass for use in such systems. Most thermoplastic polymers are too viscous and chemically unstable at the temperature required to reduce the viscosity sufficiently for centrifugal fiber spinning by this method. This is primarily due to the fact that the molten polymer is fed into an open cup. Except for the effects of rotation, the pressure inside the cup is virtually the same as the pressure outside the cup. Accordingly, if the holes in the cup are small, the polymer will move up the side of the cup and over the rim.

The above mentioned systems are illustrated by U.S. Pat. No. 4,288,397, issued Sept. 8, 1981, U.S. Pat. No. 4,294,783, issued Oct. 13, 1981, U.S. Pat. No. 4,408,972 issued Oct. 11, 1983 and U.S. Pat. No. 4,412,964 issued Nov. 1, 1983. These patents disclose a gravity feed system using a rotating cup wherein gas flows with the melt through the holes in the cup and the fiber producing condition is caused by the centrifugal force generated by the spinning of the cup and the included gas. U.S. Pat. No. 4,277,436 issued July 7, 1981 discloses a similar device using a stream of gravity fed molten material and a spinning cup so as to extrude the filaments by means of centrifugal force only.

Accordingly, an object of this invention is to provide a pressurized rotating fiber extrusion system.

A further object of the invention is to provide a rotating fiber extrusion system which is not limited to centrifugal spinning speed for controlling the extrusion rate or fiber denier.

Another object of the invention is to provide a rotating fiber extrusion system wherein it is not necessary to reduce polymer viscosity for increasing extrusion rate to improve process economics.

Yet another object of the invention is to provide a rotating fiber extrusion system wherein extrusion rate is controlled by a pumping system independent of die rotation, extrusion temperature and melt viscosity.

A further object of this invention is to provide a rotational fiber extrusion system including take-up means for producing fabric.

Yet another object of the invention is to provide a rotational fiber extrusion system including a take-up system for providing fibrous tow and yarn.

These and other objects of the invention will be obvious from the following discussion when taken together with the drawings.

BRIEF DESCRIPTION OF THE INVENTION

The present invention relates to a method and apparatus wherein there is provided a source of liquid fiber forming material, with said liquid fiber forming material being pumped into a die having a plurality of spinnerets about its periphery. The die is rotated at a predetermined adjustable speed, whereby the liquid is expelled from the die so as to form fibers. It is preferred that the fiber forming material be cooled as it is leaving the holes of the spinnerets during drawdown. The fibers may be used to produce fabrics, fibrous tow and yarn through appropriate collection and take-up systems. The pumping system provides a pumping action whereby a volumetric quantity of liquid is forced into the rotational system independent of viscosity or the back pressure generated by the spinnerets and the manifold system of the spinning head, thus creating positive displacement feeding. Positive displacement feeding may be accomplished by the extruder alone or with an additional pump of the type generally employed for this purpose. A rotary union is provided for positive sealing purposes during the pressure feeding of the fiber forming material into the rotating die.

DETAILED DESCRIPTION OF THE INVENTION

Figure 1:
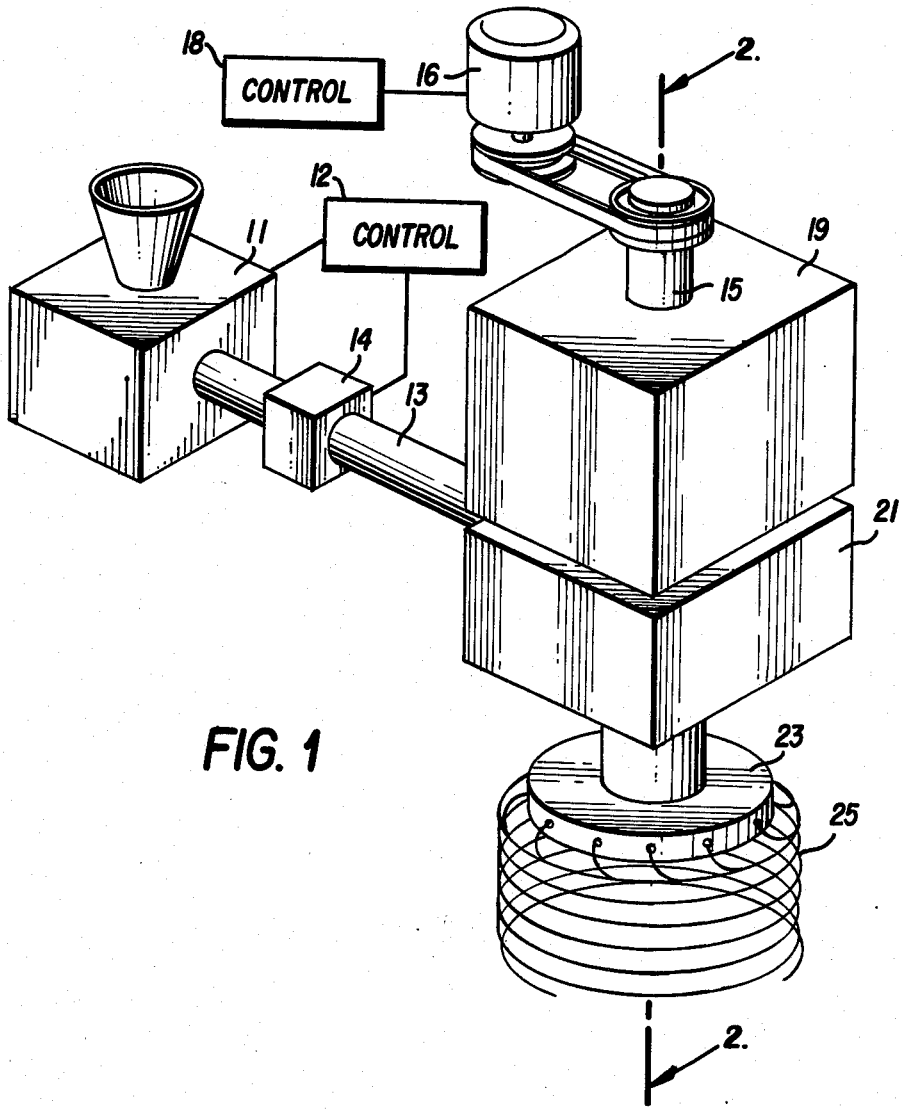
FIG. 1 is a schematic illustration of the fiber producing system of the present invention.

Turning now to the drawings, there is schematically shown in FIG. 1 a system according to the present invention for producing fibers. The system includes an extruder 11 which extrudes fiber forming material such as liquid polymer through feed pipe 13 to a rotary union 21. A pump 14 may be located in the feed line if the pumping action provided by the extruder is not sufficiently accurate for particular operating conditions. Electrical control 12 is provided for selecting the pumping rate of extrusion and displacement of the extrudate through feed pipe 13. Rotary union 21 is attached to spindle 19. Rotary drive shaft 15 is driven by motor 16 at a speed selected by means of control 18 and passes through spindle 19 and rotary union 21 and is coupled to die 23. Die 23 has a plurality of spinnerets about its circumference so that, as it is rotated by drive shaft 15 driven by motor 16 and, as the liquid polymer extrudate is supplied through melt flow channels in shaft 15 to die 23 under positive displacement, the polymer is expelled from the spinnerets and produces fibers 25 which form an orbit as shown. When used, air currents around the die will distort the circular pattern of the fibers.

Figure 3:
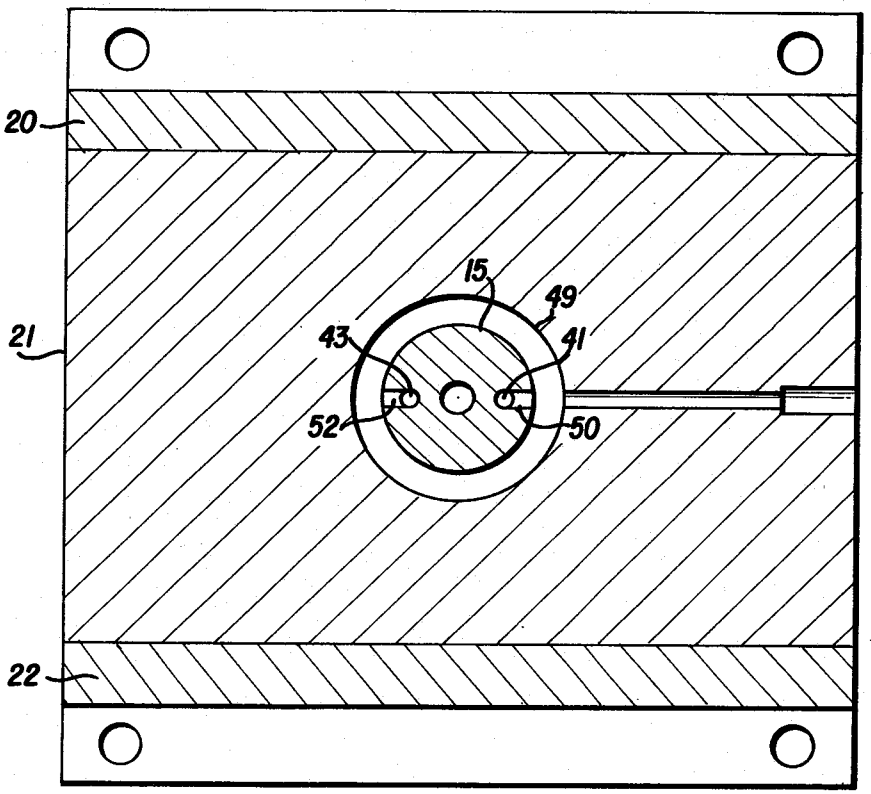
FIG. 3 is a sectional view taken along the lines 3–3 of FIG. 2.
Figure 2:
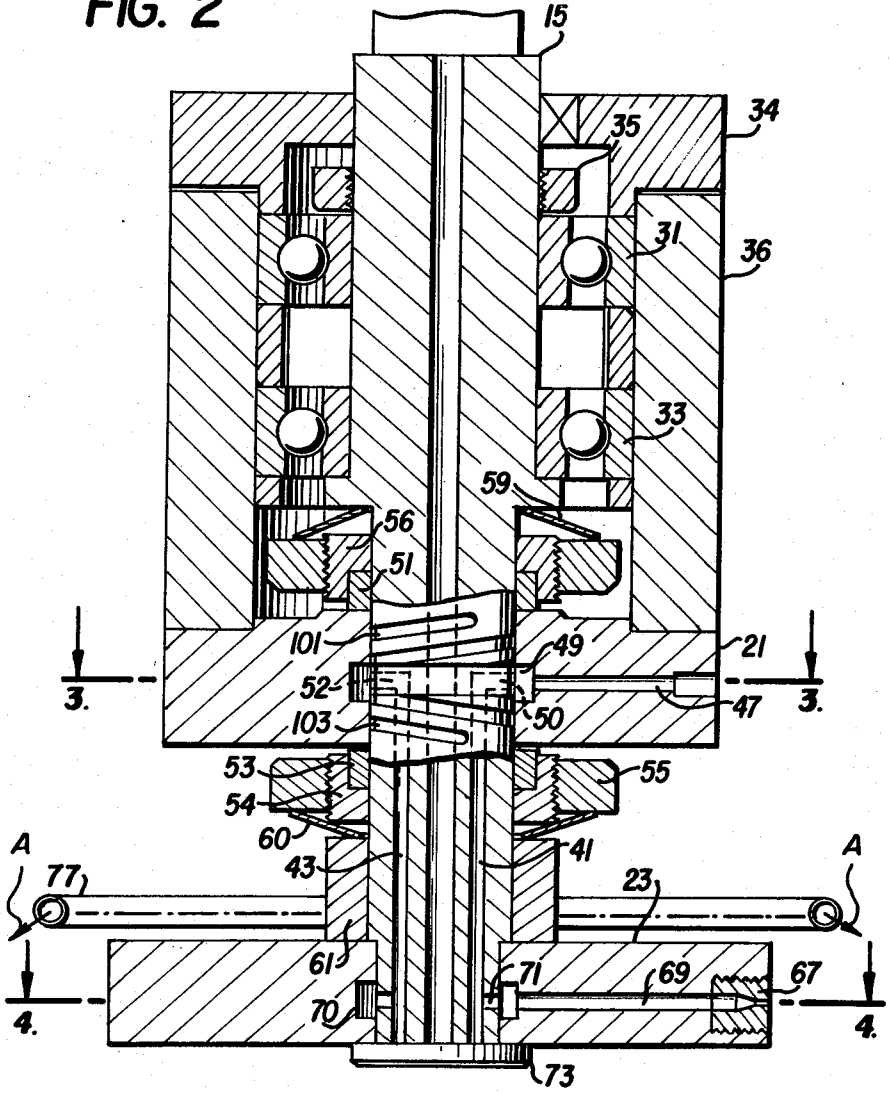
FIG. 2 is a sectional view taken along lines 2—2 of FIG. 1.
Figure 4:
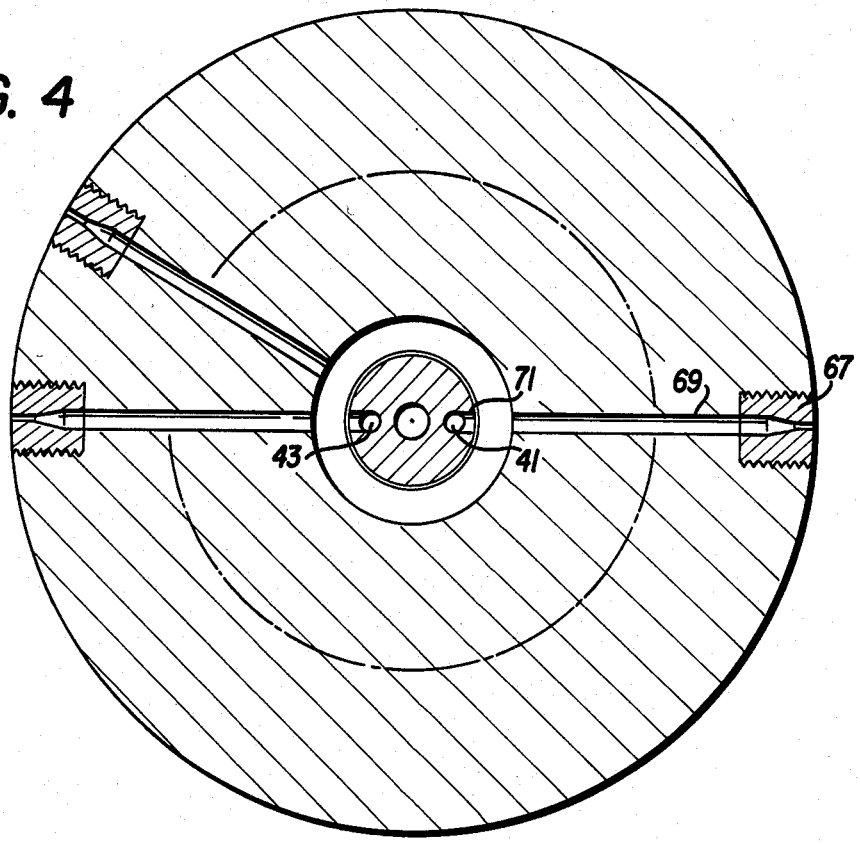
FIG. 4 is a sectional view taken along the lines 4–4 of FIG. 2.

FIGS. 2–4 illustrate one embodiment of the present invention. FIG. 2 is a cross-sectional view taken through spindle 19, rotary unit 21, die 23 and drive shaft 15 of FIG. 1. FIGS. 3 and 4 are cross sectional views taken along lines 3—3 and 4—4 of FIG. 2 respectively. Bearings 31 and 33 are maintained within the spindle by bearing retainer 34, lock nut 35 and cylinder 36. These bearings retain rotating shaft 15. Rotating shaft 15 has two melt flow channels 41 and 43. Surrounding the shaft adjacent the melt flow channels is a stationary part of rotary union 21. Extrudate feed channel 47 is connected to feed pipe 13, FIG. 1, and passes through rotary union 21 and terminates in an inner circumferential groove 49. Groove 49 mates with individual feed channels 50 and 52, FIG. 3, which interconnect groove 49 with melt flow channels 41 and 43.

The rotary union may be sealed by means such as carbon seals 51 and 53 which are maintained in place by means such as carbon seal retainers 54,56. Adjacent lower carbon seal 53 is a pressure adjustable nut 55 which, by rotation, may move the two carbon seal assemblies upwardly or downwardly. This movement causes an opposite reaction from belleville washers 59 and 60 so as to spring-load each sliding carbon seal assembly individually against the rotary unit.

Lower washer 60 rests on spacer 61 which in turn rests on die 23. Die 23 has a plurality of replaceable spinnerets 67 which are interconnected with flow channels such as flow channel 41 by means of feed channel 69 and shaft port 71 which extends through shaft 15 between channel 41 and circumferential groove 70, FIG. 4 so as to provide a constant source of extrudate. The apparatus is secured in place by means such as plate 73 secured to shaft 15.

If desired, a means for cooling the extrudate as it leaves the spinnerets may be provided, such as stationary ring 77 having outlet ports which pass air under pressure in the direction of arrows A. Ring 77 is secured in the position shown by support structure, not shown.

Further, electrical heaters 20 and 22, FIG. 3, are preferably provided in the stationary segment of rotary union 21 so as to maintain extrudate temperature.

As can be seen, the apparatus as described provides a system which is closed between the extruder and the die with the liquid extrudate being extruded through a rotary union surrounding the rotating shaft. Accordingly, as the shaft is rotated, the liquid extrudate is pumped downwardly through the melt flow channels in the rotating shaft and into the center of the circular die. The die, having a plurality of spinnerets 67, FIG. 4, about the circumference thereof, will cause a drawdown of the discharging extrudate when rotated by expelling the extrudate from the spinneret so as to form fibers 25 as schematically illustrated in FIG. 1. Die rotation therefore, is essential for drawdown and fiber formation, but it does not control extrusion rate through the die. The extrusion rate through the die is controlled by the pumping action of extruder 11 and/or pump 14.

In order to provide a long lasting high pressure seal between rotary union 21 and die 23, shaft 15 includes helical grooves 101 and 103 about its circumference on opposite sides of feed channels 50 and 52. Helical grooves 101 and 103 have opposite pitch so that, as the shaft is rotated in the direction as indicated by the arrow, any extrudate leaking between the mating surfaces of shaft 15 and rotary union 21, will be driven back into groove 49 and associated channels 50 and 52. Accordingly, leakage is substantially eliminated even under high pressure through the use of this dynamic seal.

The major variable involved in this system, besides the choice of polymer, are the pumping rate of the liquid polymer from the extruder and/or pump, the temperature of the polymer and the speed of rotation of the die. Of course, various size orifices may be used in the interchangeable spinnerets for controlling fiber formation without affecting extrusion rate. The rate of extrusion from the die, such as grams per minute per hole, is exclusively controlled by the amount of the extrudate being pumped into the system by the extruder and/or pump.

When the system is in operation, fibers are expelled from the circumference of the die and assume a helical orbit as they begin to fall below the rotating die. While the fibers are moving at a speed dependent upon the speed of rotation of the die as they are drawn down, by the time they reach the outer diameter of the orbit, they are not moving circumferentially, but are merely being laid down in that particular orbit basically one on top of the other. The orbit may change depending upon variation of rotational speed, extrudate input, temperature, etc. External forces such as electrostatic or air pressure may be employed to deform the orbit and, therefore, deflect the fibers into different patterns.

Figure 5:
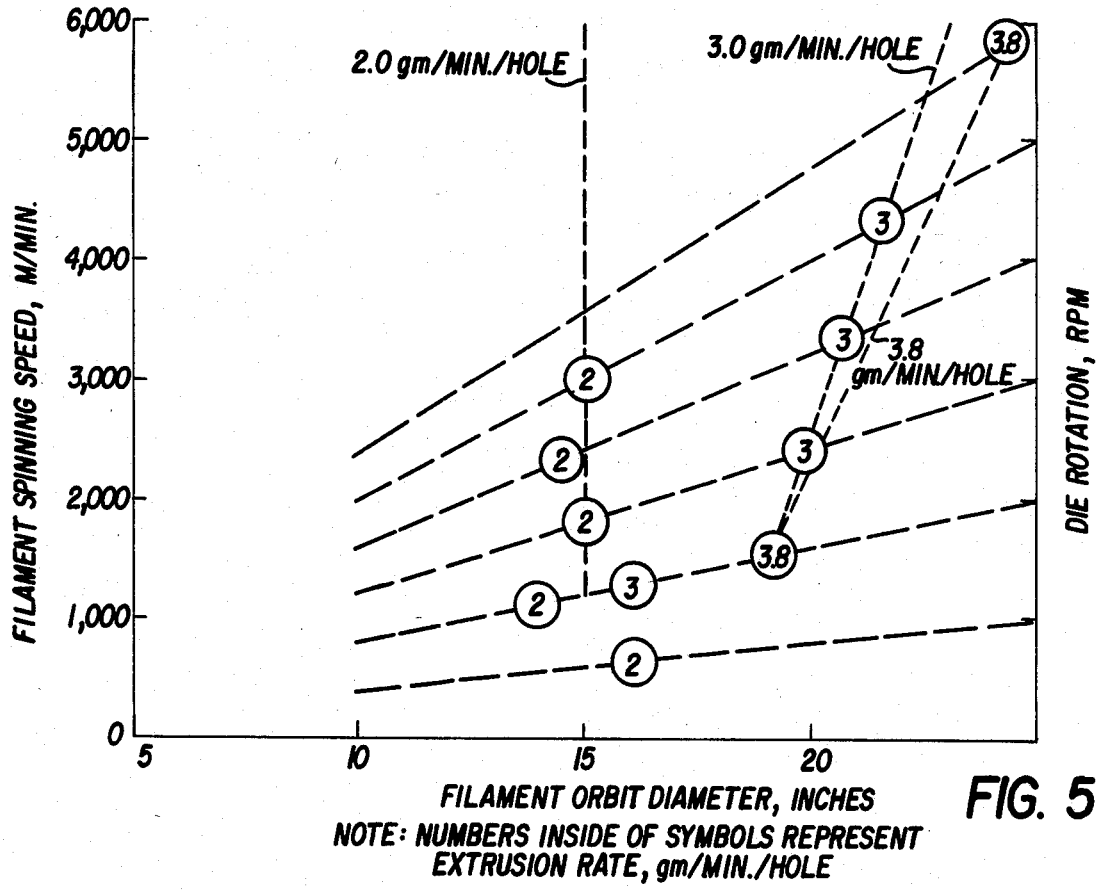
FIG. 5 is a graphical illustration of the relationship between extrusion rate, die rotation, filament orbit diameter and filament speed.
Figure 6:
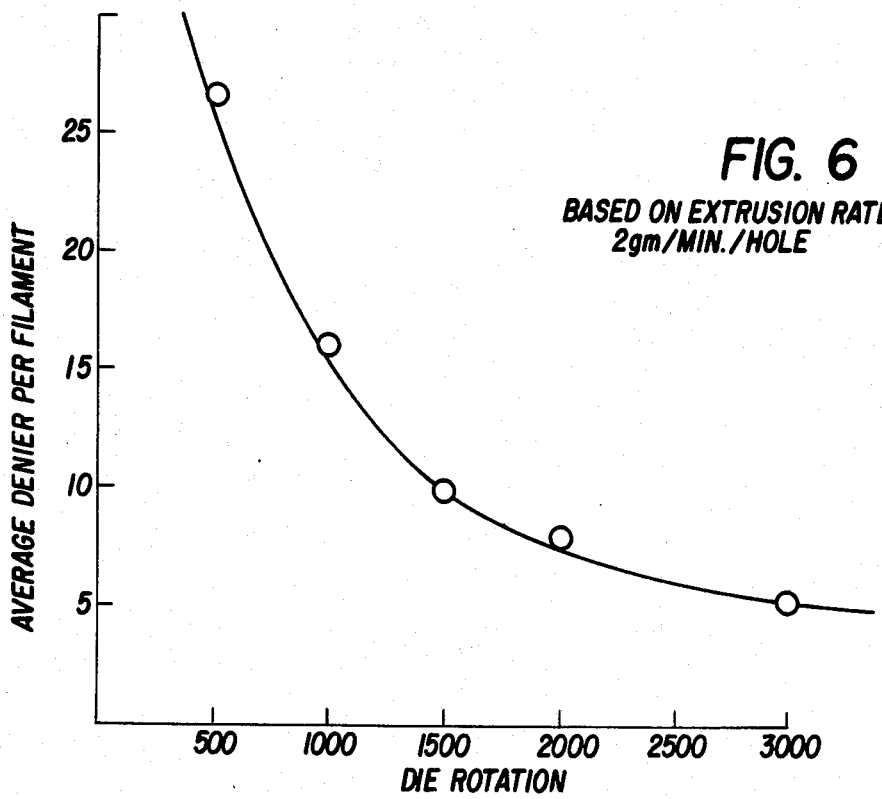
FIG. 6 is a graphical illustration of denier as a function of die rotation.

FIGS. 5 and 6 are derived from the following data.

TABLE 1

| DENIER VERSUS PROCESS CONDITIONS | | | | |
|---|---|---|---|---|
| EXTRUSION RATE (g/min/hole) | DIE ROTATION (r.p.m.) | FIL. ORBIT DIAMETER (INCHES) | FIL. SPEED M/MIN | FILAMENT DENIER |
| 1.9 | 500 | 16 | 640 | 27 |
| 2.0 | 1,000 | 14 | 1,120 | 16 |
| 2.0 | 1,500 | 15 | 1,800 | 10 |

TABLE 1-continued

| DENIER VERSUS PROCESS CONDITIONS | | | | |
|---|---|---|---|---|
| EXTRUSION RATE (g/min/hole) | DIE ROTATION (r.p.m.) | FIL. ORBIT DIAMETER (INCHES) | FIL. SPEED M/MIN | FILAMENT DENIER |
| 2.1 | 2,000 | 14.5 | 2,300 | 8 |
| 2.1 | 3,000 | 15 | 3,600 | 5 |
| 3* | 1,000 | 16 | 1,300 | 21 |
| 3* | 1,500 | 19.5 | 2,300 | 12 |
| 3* | 2,000 | 20.5 | 3,300 | 8 |
| 3* | 2,500 | 21.5 | 4,300 | 6 |
| 3.8 | 1,000 | 19.0 | 1,500 | 23 |
| 3.8* | 3,000 | 24.5 | 5,900 | 6 |

*Extrusion rate was extrapolated from screw r.p.m.
Note: Line speed = orbit circumference × die rotation Denier is based on line speed and extrusion rate FIG. 5 illustrates the relationship of the various parameters of the system for a specific polymer (Example I below) which includes the controlling parameters, pumping rate and die rotation, and their affect on filament spinning speed and filament orbit diameter. In the graph of FIG. 5, there are illustrated three different pumping rates of extrudate, which controls the extrusion rate from the die, in grams per minute per hole. In the illustration, the number inside the symbols indicates averaged pumping rate from which the graph was developed. In FIG. 6, the graph illustrates denier as a function of die rotation. As can be seen from the graphs, as the die rotational speed is increased, the filament speed and drawdown is also increased.

It is to be understood that the following examples are illustrative only and do not limit the scope of the invention.

EXAMPLE-I

Polypropylene resin, Hercules type PC-973, was extruded at constant, predetermined extrusion rates into and through a rotary union, passages of the rotating shaft, the manifold system of the die and the spinnerets. Except for the extruder, the apparatus is as shown in the cross-section of FIG. 2.

Upon extrusion, the centrifugal energy, acting on the molten extrudate causes it to draw down into fibers. The fibers form circular orbits which are larger than the diameter of the die. A stationary circular air quench ring, located above the die, as shown in FIG. 2, including orifices designed so as to direct the air downwardly and outwardly relative to the perimeter of the die, deflects the fibers at an angle of substantially 45 degrees below the plane of the die. In this example, process parameters are varied and the resultant fibers collected for testing.

1. Equipment

| | | |
|---|---|---|
| a. | Extrusion set-up: | as shown in FIG. 1 |
| b. | Extruder: | |
| | Diameter, inches: | 1.0 |
| | Temperature Zones: | 3.0 |
| | Length/diameter, inches: | 24/1 |
| | Drive, Hp: | 1.0 |
| c. | Extrusion head: | see FIG. 2 |
| d. | Die: | |
| | Diameter, inches: | 6.0 |
| | Number of spinnerets: | 16.0 |
| | Spinneret hole diameter, inches: | 0.020 |
| e. | Quench and Fiber Removal: | circular ring |
| | Ring diameter, inches: | 8.0 |
| | Orifice spacing, inches | 1.0 angled 45° downwardly and outwardly of the perimeter of the die |

-continued

2. Process Conditions

| | | | |
|---|---|---|---|
| a. | Extrusion conditions | | |
| | Extruder temperature, ° F.: | Zone-1 | 350 |
| | | Zone-2 | 400 |
| | | Zone-3 | 450 |
| | | Adapter | 450 |
| | | Rot. Union | 450 |
| | | Die | 550–600 |
| | Screw rotation, r.p.m.: | set for a given extrusion rate | |
| | Extrusion pressure, p.s.i.: | 200–400 | |
| b. | Die rotation, r.p.m.: | 500–3000 (See table below) | |
| c. | Air quench pressure, p.s.i.: | 10–30 (See table below) | |

3. Data and Results

| Extrusion Rate (g/min/hole) | Die Rotation (r.p.m.) | Fiber Orbit Diameter (inches) | Fiber Spinning Speed (meter/min) | Fiber Denier (g/9000 m) |
|---|---|---|---|---|
| 1.9 | 500 | 16 | 640 | 27 |
| 2.0 | 1,000 | 14 | 1,120 | 16 |
| 2.0 | 1,500 | 15 | 1,800 | 10 |
| 2.1 | 2,000 | 14.5 | 2,300 | 8 |
| 2.1 | 3,000 | 15 | 3,600 | 5 |
| 3.0 | 1,000 | 16 | 1,300 | 21 |
| 3.0 | 1,500 | 19.5 | 2,300 | 12 |
| 3.0 | 2,000 | 20.5 | 3,300 | 8 |
| 3.0 | 2,500 | 21.5 | 4,300 | 6 |
| 3.8 | 1,000 | 19 | 1,500 | 23 |
| 3.8 | 3,000 | 24.5 | 5,900 | 6 |

4. Extrusion Conditions

Note:

(a) Fiber orbit diamter was measured visually with an inch-ruler.

(b) Fiber spinning speed was calculated (speed = orbit circumference x rotation).

(c) Denier was calculated, based on extrusion rate and fiber spinning speed in the well known manner.

According to the results of this experiment, the fibers become smaller with increasing die rotation, Furthermore, increasing extrusion rate, at a given die rotation, increases filament orbit and, therefore, decreases the rate of increase of filament denier.

EXAMPLE II

In the apparatus described in Example I, a polyethylene methacrylic copolymer (DuPont Ionomer resin type Surlyn-1601) was extruded. Fibers of various deniers were produced at different die rotations.

Process Conditions

| | | | |
|---|---|---|---|
| a. | Extrusion conditions | | |
| | Temperature | Zone-1 | 300 |
| | | Zone-2 | 350 |
| | | Zone-3 | 400 |
| | | Adapt. | 400 |
| | | Rot. Union | 400 |
| | | Die | 500–550 |
| | Screw rotation, r.p.m.: | | 10 |
| | Screw pressure, p.s.i.: | | 100–200 |
| b. | Die rotation, r.p.m.: | | 1000, 2000, 3000 |
| c. | Air quench pressure, p.s.i.: | | 10–30 |

In another variation of this example, fibers were collected on the surface of a moving screen. The screen was moved horizontally, four inches below the plane of the die. Upon contact of the fibers with each other, the fibers were bonded to each other at the point of contact. The resultant product is a nonwoven fabric. The fabric was then placed between a sheet of polyurethane foam and a polyester fabric. Heat and pressure was then applied through the polyester fabric. The lower melting ionomer fabric was caused to melt and bond the two substrates into a composite fabric.

EXAMPLE III

In the apparatus of Example I, the following polymers which are listed in the table below, have been converted into fibers and fabrics.

Polymers Converted into Fibers and Fabrics

| Polymer | | Extrusion Temp. ° F. | Die Temp. ° F. |
|---|---|---|---|
| Polypropylene | Amoco CR-34 | 400–500 | 550–625 |
| Polyioner | Surlyn 1601 | 350–400 | 450–550 |
| Nylon terpolymer | Henkel 6309 | 280–300 | 350–400 |
| Polyurethane | Estane 58122 | 350–400 | 450–400 |
| Polypropylene-ethylene copolymer | | 400–500 | 550–600 |

Spunbonded fabrics are produced by allowing the freshly formed fibers to contact each other while depositing on a hard surface. The fibers adhere to each other at their contact points thus forming a continuous fabric. The fabric will conform to the shape of the collection surface. In this example, fibers were deposited on the surface of a solid mandrel comprising an inverted bucket. The dimensions of this mandrel are as follows.

| | |
|---|---|
| Bottom diameter, inches: | 7.0 |
| Top diameter, inches: | 8.25 |
| Height of mandrel, inches: | 7.0 |

EXAMPLE IV

Nylon-6 polymer, 2.6-relative viscosity (measured in sulfuric acid), was converted into low-denier textile fibers and spun-bonded continuously into a nonwoven fabric. The fabric was formed according to the apparatus of FIG. 8. The extrusion head employed is illustrated in the cross section of FIG. 7. The fabric produced in this system is very uniform and even, with good balance in physical properties.

Equipment and Set-up

Figure 8:
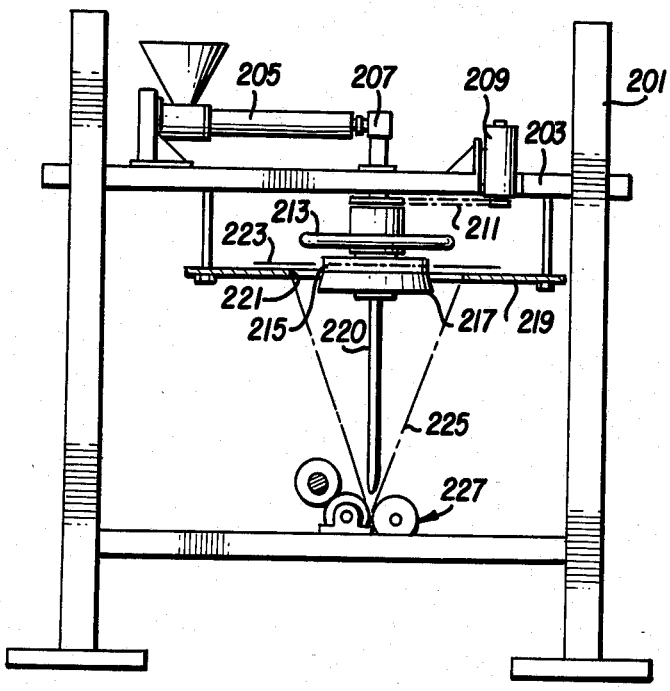
FIG. 8 is a schematic illustration of a system for producing a fabric.
Figure 7:
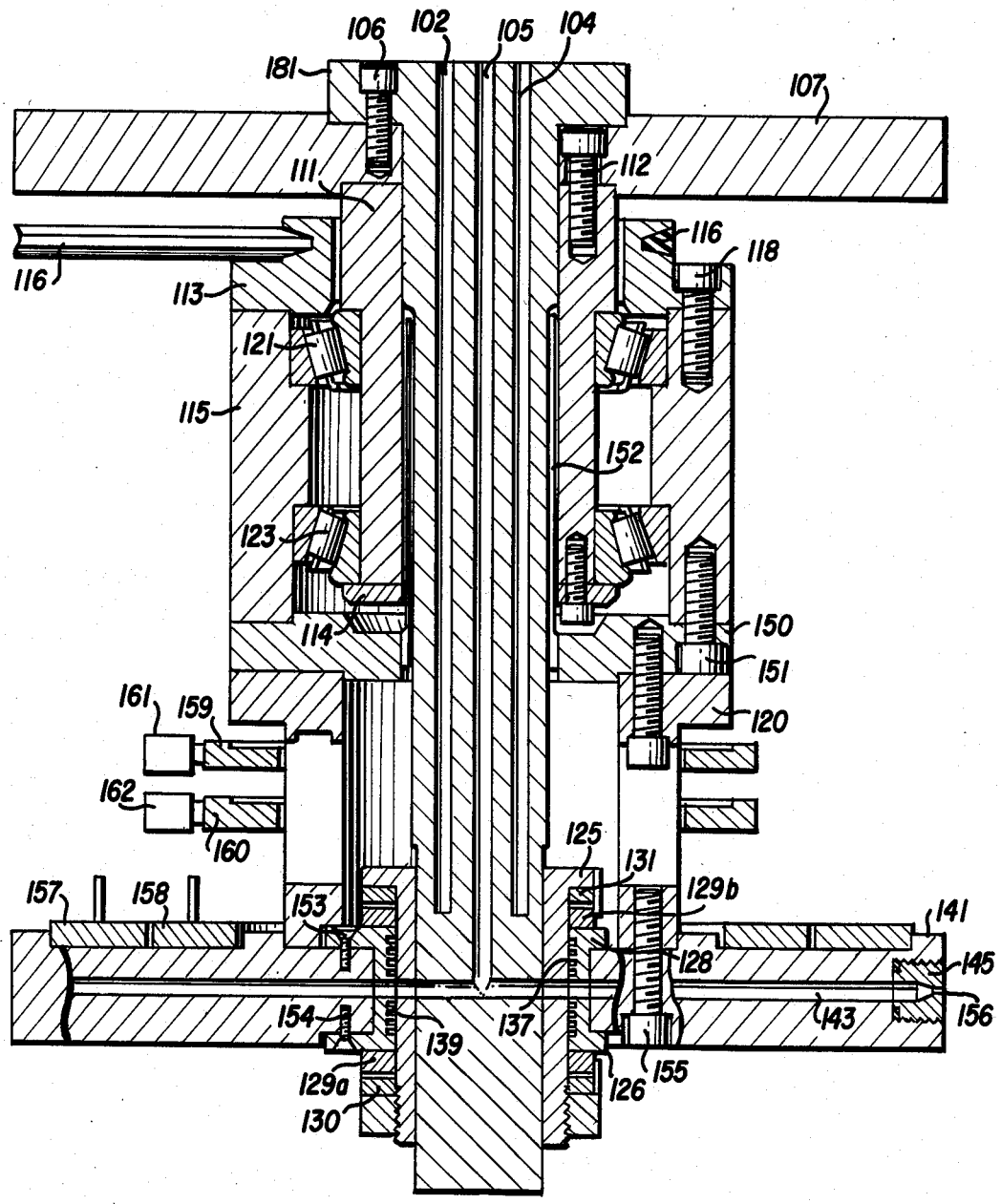
FIG. 7 illustrates a modification of FIG. 2.

| Set-Up | | FIG. 8 |
|---|---|---|
| a. | Extruder | One-inch diameter, One Hp drive |
| b. | Extrusion head | FIG. 7 Stationary shaft, rotating die grooves are in the outside member of the rotary union |
| c. | Die, diameter, inches | 12.0 |
| | numbers of spinnerets | 16 |
| | spinning holes per spinneret | 1 (0.020 in. diameter) |
| d. | Quench ring, diameter, inches | 14.0 |

orifices: 0.06 inches diameter at 1" spacing, angled 45 degrees downwardly and outwardly Process Conditions

| | | |
|---|---|---|
| Extrusion Temperature, °F. | Z-1: | 480° F. |
| | Z-2: | 670° F. |
| | Z-3: | 620° F. |
| | Adapter: | 550° F. |
| | Melt Tube: | 600 |
| | Die heaters | 13 amp |
| Extruder screw rotation, r.p.m. | | 33.0 |
| Die rotation, r.p.m. | | 2530. |
| Air-quench pressure, psi | | 30. |
| Winder speed, ft/min | | 10. |

Product

| | 2-ply, lay-flat fabric |
|---|---|
| Width, inches | 35. |
| Basis Weight oz/yd$^2$ | 0.75 |

The hole diameter of the spinneret is preferably between 0.008" and 0.030 inches with the length-to-diameter ratio being between 1:1 and 7:1. This ratio relates to desired pressure drop in the spinneret.

Shaped, tubular articles were formed by collecting fibers on the outside surface of a mandrel. The mandrel used in this experiment was a cone-shaped, inverted bucket. The mandrel was placed concentric with, and below a revolving, 6-inch diameter die. The centrifugal action of the die and the conveying action of the air quench system caused fibers to be deposited on the surface of the mandrel (bucket), thus forming a shaped textile article. The resultant product resembles a tubular filter element and a textile cap.

In another experiment, a flat plate was placed below the rotating die. The flat plate was slowly withdrawn in a continuous motion thereby producing a continuous, flat fabric.

The air quench with its individual air streams causes fiber deflection and fiber entanglement, thereby producing an interwoven fabric with increased integrity.

Copolymer and Polymer Blends

Virtually every polymer, copolymer and polymer blend which can be converted into fibers by conventional processing can also be converted into fibers by centrifugal spinning. Examples of polymer systems are given below:

Polyolefin polymers and copolymers;

Thermoplastic polyurethane polymers and copolymers;

Polyesters, such as polyethylene and polybutylene terephthalate;

Nylons;

Polyionomers;

Polyacrylates;
Polybutadienes and copolymers;
Hot melt adhesive polymer systems;
Reactive polymers.

EXAMPLE V

In the apparatus of Example IV, thermoplastic polyurethane polymer, Estane 58409 was extruded into fibers, collected on an annular plate and withdrawn continuously as a bonded non-woven fabric. Very fine textile fibers were produced at high die rotation without evidence of polymer degradation.

Process conditions

Extrusion Temperatures, °F.

| | |
|---|---|
| Z-1: | 260 |
| Z-2: | 330 |
| Z-3: | 350 |
| Adapter | 350 |
| Melt tube | 250 |
| Die (7 amps) | 450–500 |
| Quench air pressure | 20 psi |
| Die rotation, r.p.m. | 2,000.00 |
| Extruder-Screw rotation, r.p.m. | 12.0 |

Process Parameters Controlling Fiber Production

As will be evident from the above illustrations, three major criteria govern the control of fiber formation from thermoplastic polymers with the present system:

1. Spinneret hole design and dimension will affect the process and fiber properties as follows:
   a. control drawdown for a given denier
   b. govern extrudate quality (melt fracture)
   c. affect the pressure drop across the spinnerets
   d. fiber quality and strength and fiber processability (in-line stretching and post-stretching propensity)
   e. process stability (line speed potential, productivity, stretch, etc.).
2. Extrustion rate, which is governed by pumping rate of the extruder and/or additional pumping means, will affect
   a. fiber denier
   b. productivity
   c. process stability
3. Die rotation, which controls filament spinning speed influences and controls
   a. drawdown
   b. spinline stability
   c. denier
   d. productivity for a given denier It should be noted that temperature controls process stability for the particular polymer used. The temperature must be sufficiently high so as to enable drawdown, but not so high as to allow excessive thermal degradation of the polymer.

In the conventional non-centrifugal fiber extrusion process and in the centrifugal process of this invention, all three variables are independently controllable. However, in the known centrifugal process discussed above these variables are interdependent. Some of this interdependency is illustrated below.

1. Spinneret hole design will affect extrusion rate since it determines part of the backpressure of the system.
2. Extrusion rate is affected by die rotation, the pressure drop across the manifold system, the spinneret size, polymer molecular weight, extrusion temperature, etc.
3. Filament speed will depend on the denier desired and all of the beforementioned conditions, especially die rotation and speed.

Thus, it can be seen that the system of the present invention provides controls whereby various deniers can be attained simply by varying die rotation and/or changing the pumping rate.

It will be apparent from the above disclosure that since the extrudate is being pumped into the system at a controlled rate, the total weight of the extruded fibers can be increased by increasing the amount of extrudate being pumped into the system. Additionally, the consistency and control of fiber production is much greater than that for fibers which are extruded depending solely upon centifugal force to drive the extrudate through the holes in the wall of a cup as described in the patents cited hereinabove.

The fibers may be used by themselves or they may be collected for various purposes as will be discussed hereinafter.

FIG. 7 discloses a modified system similar to FIG. 1 wherein the central shaft remains stationary and the die is driven by external means so that it rotates about the shaft. The actual driving motor is not shown although the driving mechanism is clearly illustrated.

Non-rotatable shaft 181 includes extrudate melt flow channel 105 therethrough which interconnects with feed pipe 13 of FIG. 1. There is also provided a utility channels 102 and 104 which may be used for maintaining electrical heating elements (not shown). Shaft 101 is supported and aligned at its upper end by support plate 107 and is secured thereto by bolt 106 and extends downwardly therefrom.

Cylindrical inner member 111 is secured and aligned to plate 107 by means such as bolt 112. At its lower end, inner member 111 has secured thereto a flat annular retainer plate 114 by means of a further bolt. Plate 114 supports outer member 115 of the spindle assembly and has bearings 121 and 123 associated therewith. Onto the lower end of outer member 115 is bolted an annular plate 150 by means of bolts such as 151. A thin-walled tube 152 is welded on the inside wall of member 150. The three interconnected members 152, 150, and 115 form an annular vessel containing bearings 121 and 123 and oil for lubrication. The entire vessel is rotated by drive pulley 113 which is driven by belt 116 and is secured to outer member 115 by means such as bolt 118. The rotating assembly is connected to die 141 by means of adapter 120 and rotates therewith.

Bushing 125 surrounds shaft 101 and supports graphite seals **129*a* and 129*b* and springs 130 and 131 on either side thereof. Sleeves 126 and 128 are secured to the die by screws 153 and 154 and rotate with die 141. The inside surfaces of the sleeves include integral grooves 137 and 139 which extend above and below melt flow channel 143 so as to drive any liquid extrudate leaking along the sleeves towards channel 143 in the same manner as is described in connection with the grooves on the rotating shaft of FIG. 2**.

The die 141 is bolted onto the adapter 120 via bolts such as bolt 155. Each melt flow channel, such as 143, contains replaceable spinneret 145 with melt spinning hole 156. Melt flow channel 143 terminate at their inner ends with melt flow channels 105. The die is heated with two ring heaters 157 and 158 which are electrically connected to a pair of slip rings 159 and 160 by means not shown. Power is introduced through brushes 161 and 162 and regulated by a variable voltage controller (not shown).

FIG. 8 is a schematic illustration of an assembly using the present invention to form fabrics.

Unistrut legs 201, support base frame 203 which in turn supports extruder 205. Extruder 205 feeds into adapter 207 and passes downwardly to die 215. Motor 209 drives belt 211 which in turn rotates the assembly as described in FIG. 7. Stationary quench ring 213 of the type shown in FIG. 2 surrounds the die as previously discussed so as to provide an air quench for the fibers as they are extruded. A web forming plate 219 is supported beneath the base support frame and includes a central aperture 221 which is of a larger diameter than the outside diameter of the rotating die.

As the die is rotated and the fibers are extruded, they pass beyond aperture 221 and strike plate 219. Fibers are bonded during contact with each other and plate 219, thus producing nonwoven fabric 225 which is then drawn back through aperture 221 as tubular fabric 225. Stationary spreader 220 supported below the die, spreads the fabric into a flat two-ply composite which is collected by pull roll and winder 227. Thus, the fabric which is formed as a result of the illustrated operation may be collected in a continuous manner.

Figure 9:
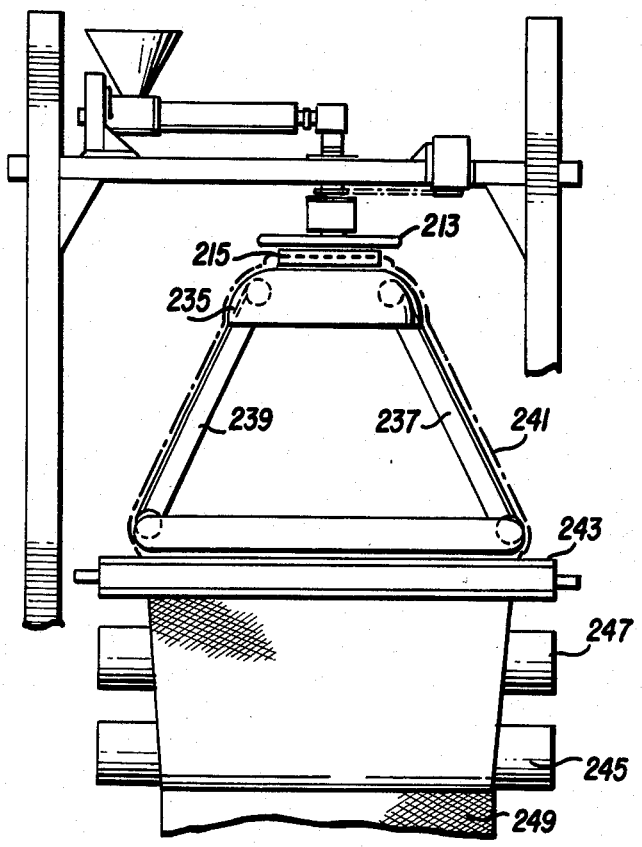
FIG. 9 is a schematic illustration of a system producing a stretched web of FIG. 8.
Figure 10:
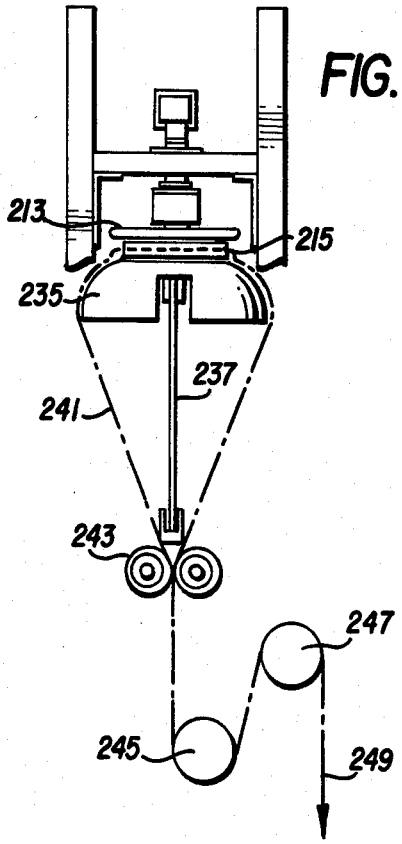
FIG. 10 is a side view of the system of FIG. 9.

FIGS. 9 and 10 are schematic representations of a plan and side view of a web forming system using the present invention.

The frame structure and extruder and motor drive are the same as described in connection with FIG. 8. The die is substantially the same as in FIG. 8 and includes therewith the quench ring 213.

In the web forming system, mandrel 235 is added below and substantially adjacent die 215. As can be seen, mandrel 235 is substantially domed shaped with a cut out portion to accommodate continuous belts 237 and 239 which constitute a spreader. As the fibers leave die 215 in an orbit fashion, they drop downwardly onto the mandrel and are picked up and spread by continuous belts 237 and 239.

Nip roll 243 is located below belts 237 and 239 and draws web 241 downwardly as it passes over the spreader, thus creating a layered web.

Layered web 249 then passes over pull roll 245 and 247 and may be stored on a roll (not shown) in a standard fashion.

Figure 11:
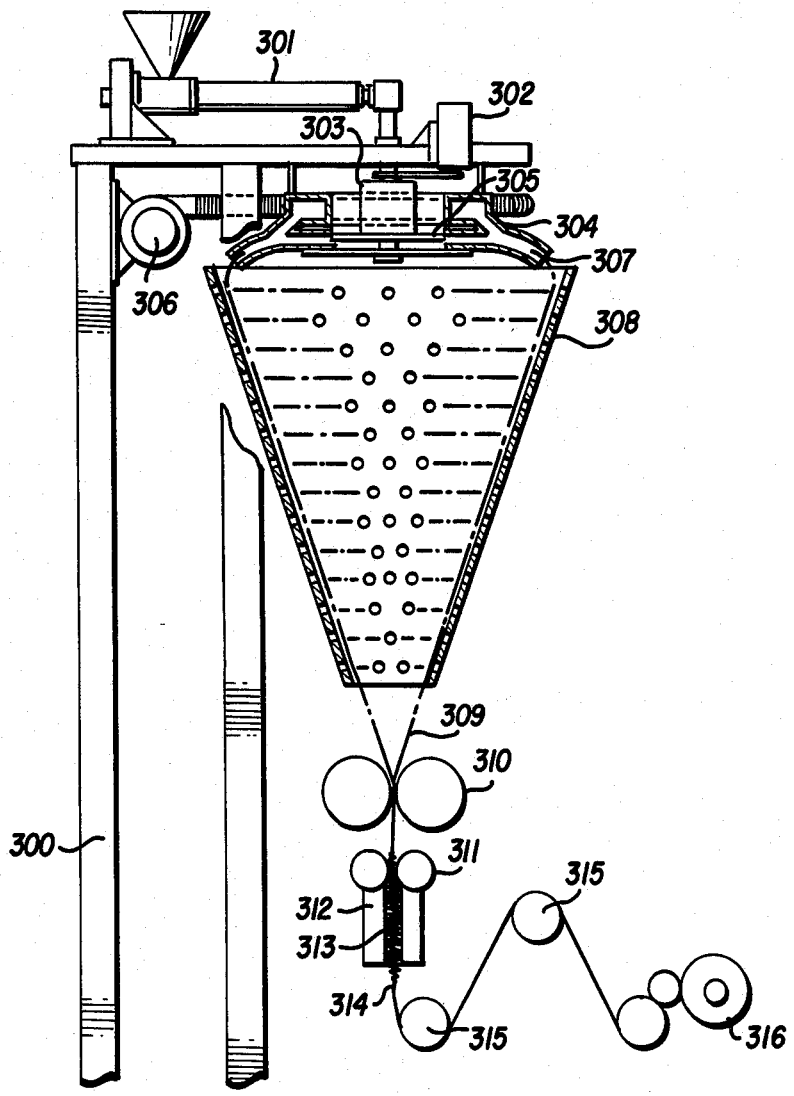
FIG. 11 is a schematic illustration of a system for producing yarn.

FIG. 11 is a schematic of a yarn and tow forming system using the present invention.

Frame 300 supports extruder 301, drive motor 302 and extrusion head 303 in a manner similar to that discussed in connection with FIG. 8. Radial air aspirator 304 is located around die 305 and is connected to air blower 306. Both are attached to frame 300. In operation, fibers are thrown from the die by centrifugal action into the channel provided by aspirator 304. The air drag created by the high velocity air causes the fibers to be drawndown from the rotating die and also to be stretched. The fibers are then discharged into perforated funnel 308 by being blown out of aspirator 304. The fibers are then caused to converge into a tow 309 while being pulled through the funnel by nip rolls 310. Tow 309 may then be stuffed by nip rolls 311 into crimper 312 and crimped inside of stuffing box 313, producing crimped tow 314. The crimped tow is then conveyed over rolls 315 and continuously packaged on winder 316.

The above description, examples and drawings are illustrative only since modifications could be made without departing from the invention, the scope of which is to be limited only by the following claims.

I claim:

1. Apparatus for forming an article comprising fibers comprising a rotatable die comprising a periphery and an interior;

means for rotating said die;

at least one spinneret in said periphery of said die having an unobstructed orifice therethrough connected to said interior of said die, said orifice terminating substantially at said periphery of said rotatable die;

a source of molten polymer fiber-forming material;

at least one substantially leakproof closed channel interconnecting said rotatable die, said spinneret and said source of said molten polymer fiber-forming material; and means for pumping said molten polymer fiber-forming material under a preselected positive pressure from said source through said channel to said die and said spinneret whereby said pumping means controls the extrusion rate of said molten polymer fiber-forming material through said spinneret so as to provide a predetermined continuous volumetric quantity of said fiber-forming material to said spinneret substantially independent of the viscosity of said material or a back pressure generated by said spinneret and the interior of said rotating die;

where said molten polymer fiber-forming material is expelled from said spinneret so as to produce fibers.

2. The apparatus of claim 1 further comprising means for selectively controlling the positive pressure generated by said pumping means whereby the volumetric quantity of said molten polymer fiber-forming material being pumped through said channel may be regulated.

3. The apparatus of claim 1 further comprising means for controlling the temperature of said molten polymer fiber-forming material within said channel and said die.

4. The apparatus of claim 1 wherein said means for pumping said molten polymer fiber-forming material is an extruder.

5. The apparatus of claim 1 wherein said means for pumping said molten polymer fiber-forming material comprises an extruder and a pump between said extruder and said rotatable die.

6. The apparatus of claim 1 further comprising means for selectively controlling the rotational speed of said die.

7. The apparatus of claim 6 wherein the die is rotated with a peripheral speed of between 500–1500 meters/-min.

8. The apparatus of claim 1 wherein said spinneret is replaceable.

9. The apparatus of claim 1 further comprising a plurality of spinnerets about said periphery of said die.

10. The apparatus of claim 1 wherein the diameter of said orifice in said spinneret is between 0.005–0.100 inches in diameter.

11. The apparatus of claim 1 wherein the diameter of said orifice in said spinneret is between 0.008–0.040 inches in diameter.

12. The apparatus of claim 1 further comprising means for controlling fiber removal from the immediate vicinity of the outer surface of said die.

13. The apparatus of claim 1 further comprising dynamic sealing means within said interconnecting channel between said pumping means and said die.

14. The apparatus of claim 13 wherein said dynamic sealing means is located between said channel and the interior surface of said die.

15. The apparatus of claim 1 further comprising means for forming a fabric from said fibers.

16. The apparatus of claim 1 further comprising means for forming a yarn from said fibers.

17. The apparatus of claim 1 further comprising means for cooling said fibers after they are expelled from said spinneret.

18. The apparatus of claim 17 wherein said cooling means comprises a stationary perforated ring substantially surrounding said die for directing pressurized air onto said fibers.

19. Apparatus for forming an article comprising fibers form a polymer comprising means for providing a source of liquid polymer fiber-producing material from said polymer;

a feed pipe connected to said source providing means;

means for pumping a predetermined volumetric quantity of said liquid polymer fiber-producing material through said feed pipe under a predetermined positive pressure;

a rotatable die comprising a periphery;

a plurality of spinnerets having unobstructed orifices therethrough in said periphery of said rotatable die, said orifices terminating substantially at said periphery of said die;

a shaft coupled to said rotatable die;

a feed channel in said shaft interconnecting said die, including said spinnerets, and said feed pipe;

sealing means between said feed pipe and said die so as to provide a substantially leakproof closed channel between said source providing means and said die including spinnerets whereby said pumping means controls the extrusion rate of said liquid polymer fiber-producing material through said spinnerets;

means for rotating said rotatable die whereby said liquid polymer fiber-producing material is expelled from said spinnerets so as to produce fibers.

20. The apparatus of claim 19 wherein said sealing means comprises a dynamic seal between said feed pipe and said feed channel.

21. The apparatus of claim 20 wherein said means for rotating said die comprises a motor for rotating said die about said shaft.

22. The apparatus of claim 19 further comprising means for selectively controlling said preselected positive pressure so as to control said volumetric quantity of said liquid polymer fiber-producing material at said spinneret.

23. The apparatus of claim 19 further comprising means for selectively controlling said means for rotating said die so as to provide a preselected speed of rotation.

24. The apparatus of claim 19 further comprising means for controlling the temperature of said liquid polymer fiber-producing material in said feed channel and said die.

25. The apparatus of claim 19 further comprising a substantially flat plate extending coaxially about said die; and an opening in said plate;

whereby fibers exiting from said die strike said plate and bond so as to form a web which is subsequently drawn downwardly through said opening.

26. The apparatus of claim 25 further comprising means below said opening for collecting and storing said web.

27. The apparatus of claim 19 further comprising a mandrel below said die for collecting said fibers so as to form a web;

spreader means adjacent said mandrel for collecting said web as it drops from said mandrel so as to form a layered web; and means for storing said layered web.

28. The apparatus of claim 19 further comprising a radial air aspirator surrounding said die and having an outlet channel;

an air blower for providing air to said aspirator;

a perforated funnel mounted below said aspirator and having its large end of a greater diameter than the diameter of said outlet channel; and means below said funnel for pulling said fibers from said funnel;

whereby said fibers are thrown from the die into said channel, drawn-down and stretched, and converged into a tow with said tow being pulled from said funnel.

29. The apparatus of claim 28 further comprising means for crimping and storing said tow.

30. Apparatus for forming fibers comprising a rotatable die comprising a periphery and having at least one spinneret with an unobstructed orifice therethrough, said orifice terminating substantially at said periphery of said rotatable die;

means for rotating said die;

a source of liquid fiber-forming material;

a substantially leakproof closed channel interconnecting said source of said liquid fiber-forming material and said rotatable die including said spinneret;

means for pumping said liquid fiber-forming material under a preselected positive pressure from said source to said spinneret so as to provide a continuous volumetric quantity of said liquid fiber-forming material from said source through said channel and through said rotatable die to said spinneret; and means for varying said positive pressure so as to control the quantity of said liquid fiber-forming material which said pump feeds to said spinneret;

whereby the quanity of said liquid fiber-forming material fed to said spinneret controls the extrusion rate through said spinneret.

31. The apparatus of claim 30 further comprising means for selectively controlling the rate of rotation of said die;

whereby the filament spinning speed is controlled by the peripheral speed of said die.

32. The apparatus of claim 31 further comprising heating means for controlling the temperature of said liquid fiber-forming material between said source and said die;

whereby the temperature of said liquid material is maintained sufficiently high for subsequent drawdown while preventing thermal degradation of said fluid.

33. Apparatus for forming an article comprising fibers from a polymer extrudate comprising a rotatable die comprising a periphery and an interior;

means for rotating said die at a selectable rate;

a plurality of spinnerets spaced about said periphery of said rotating die, each of said spinnerets having an unobstructed orifice therethrough connected at one end to said interior of said die, said orifices terminating at the other end substantially at said periphery of said rotatable die;

a source of liquid polymer molten fiber-forming material;

a substantially leakproof closed channel interconnecting said rotatable die, including said spinnerets, and said source of molten liquid polymer fiber-forming material;

dynamic sealing means between said source of material and said rotatable die;

means for pumping said molten liquid polymer fiber-forming material through said channel to said rotating die and spinnerets at a predetermined positive pressure so as to provide a continuous preselected volumetric quantity substantially independent of the viscosity of said material or a back pressure generated by said spinneret and said interior of said rotating die, whereby said liquid polymer molten fiber-forming material is expelled from said spinneret at a controlled rate so as to produce a fiber;

a substantially flat plate extending coaxially about said die, said plate having a dimension sufficient to intercept fibers expelled from said spinnerets; and a substantially circular opening in said plate;

whereby fibers exiting from said die strike said plate and bond so as to form a web which is subsequently drawn downwardly through said opening.

* * * * *